United States Patent [19]

Duca

[11] 4,100,365

[45] Jul. 11, 1978

[54] HOUSING FOR AN INDUCTION FURNACE

[75] Inventor: William J. Duca, Youngstown, Ohio

[73] Assignee: American Induction Heating Corporation, Detroit, Mich.

[21] Appl. No.: 752,152

[22] Filed: Dec. 20, 1976

[51] Int. Cl.[2] ..... H05B 5/00

[52] U.S. Cl. ..... 13/27

[58] Field of Search ..... 13/26, 27

[56] References Cited

U.S. PATENT DOCUMENTS

| | | | |
|---|---|---|---|
| 1,810,820 | 6/1931 | Davis et al. | 13/27 |
| 3,004,091 | 10/1961 | Tama et al. | 13/27 |
| 3,944,715 | 3/1976 | Hegewaldt et al. | 13/27 |

*Primary Examiner*—R. N. Envall, Jr.

*Attorney, Agent, or Firm*—Krass & Young

[57] ABSTRACT

A housing including an open-cage type framework for a coreless induction furnace. The framework includes upper and lower horizontally disposed ring members. Each ring member is constructed of a non-magnetic metal except for an insulating fastener in each ring which closes the ring mechanically but prevents a continuous electrical path or loop in each ring. The upper and lower rings are joined by a plurality of vertical columns which are similarly electrically insulated from the rings. The framework thus provides a rigid structure for supporting the internal furnace components while at the same time insuring that deleterious current paths or loops in the framework are not created during operation.

10 Claims, 7 Drawing Figures

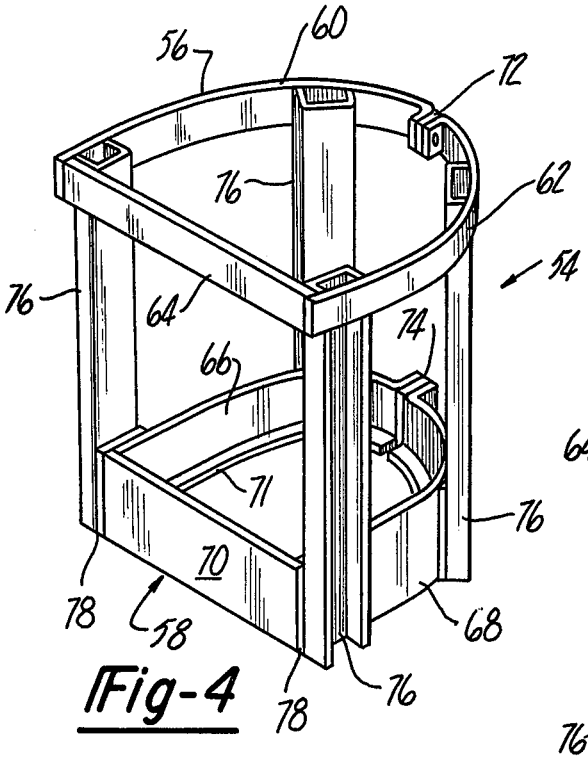
Fig-4
Fig-6
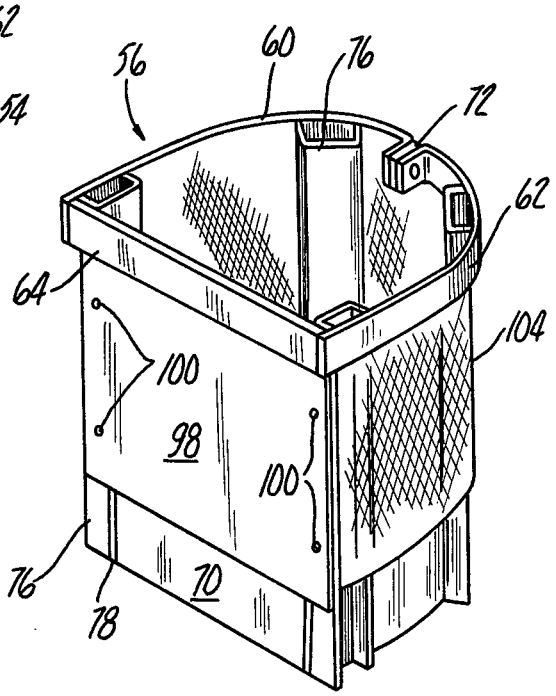
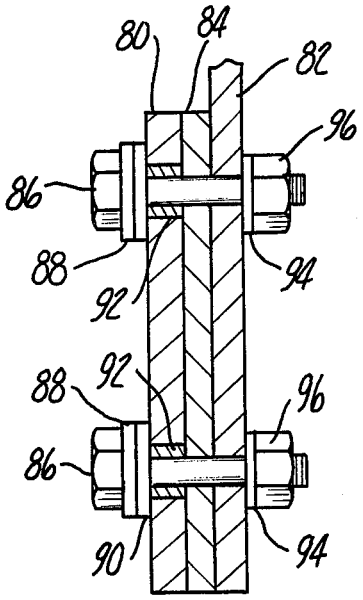
Fig-5
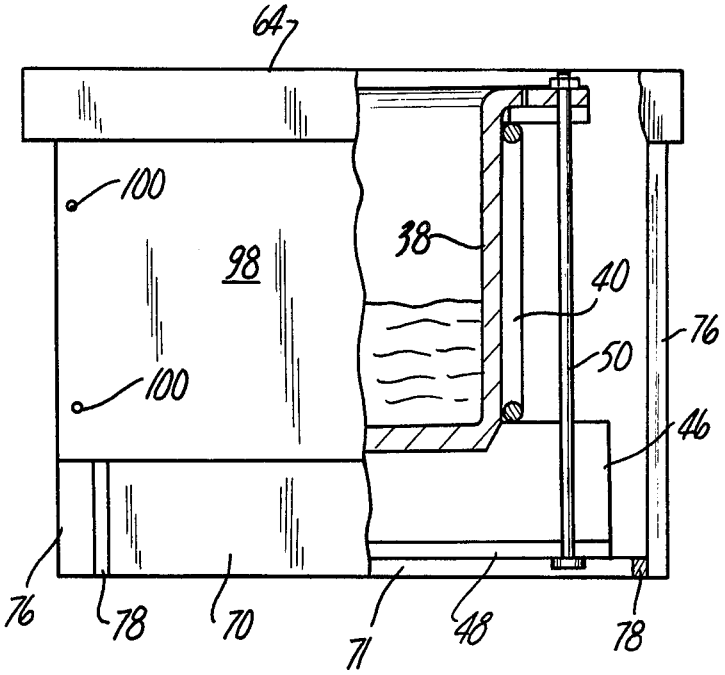
Fig-7

HOUSING FOR AN INDUCTION FURNACE

BACKGROUND OF THE INVENTION

This invention relates to an induction furnace for heating and melting metals. More particularly, it involves a housing for a high frequency coreless induction furnace which does not use magnetic laminations, known as yokes or shunts, for the external magnetic flux path.

High frequency coreless induction furnaces have been used for some time for heating and melting metals. Generally, the internal components of the furnace include a container which is surrounded by an induction coil which generates high frequency electromagnetic fields which heat the metal in the container. The internal components are supported by an outer protective shell or frame. In induction melting furnaces, the frame must not provide a continuous current path perpendicular to the axis of the coil commonly referred to as a loop; otherwise, the frame itself may be heated by the induction coil. In addition, it has been known to construct the frame of nonmagnetic materials, such as aluminum, to further minimize inductive heating of the frame. However, the structure of the known induction heating frameworks have been unable to provide the rigidity and necessary support for the internal components of the induction furnace. The prior art housings have been known to flex and cause breakage of the components and protective panels surrounding the internal components.

OBJECTS AND SUMMARY OF THE INVENTION

Therefore, it is the primary object of this invention to provide an improved housing for a high induction furnace which provides excellent mechanical rigidity for the internal furnace components, while at the same time preventing undesirable current paths or loops therein.

This and other objects of this invention are provided by a housing framework constructed of upper and lower horizontally disposed rings, with each ring being closed by an insulating fastener to prevent undesirable current paths or loops therein. The upper and lower rings are joined by a plurality of vertical columns to provide the necessary mechanical strength to support the internal induction furnace components and surrounding protective panels. At least one end of each of the vertical columns are similarly electrically insulated from the rings to even further insure against unwanted current paths or loops. In a preferred embodiment, the housing includes a protective front panel suspended between the upper and lower rings for protecting the furnace coil from metal splashing during pouring. The frame also includes an observation screen extending around the remaining portion of the frame to permit an operator to observe the coil during the melting operation. The lower ring preferably includes an inwardly projecting lip portion on which a bottom enclosure panel is supported. Thus, the internal furnace components can be inserted into the protective housing and supported on the bottom panel.

BRIEF DESCRIPTION OF THE DRAWINGS

Other objects and advantages of the invention will become apparent upon reading the following detailed description and upon reference to the drawings, in which:

FIG. 4 is a perspective view showing one embodiment of the framework for a coreless induction furnace made in accordance with this invention;

FIG. 5 is an enlarged cross sectional view showing one embodiment of the insulated fastener securing portions of the framework together;

FIG. 6 is a perspective view of the housing of this invention shown utilizing the framework in FIG. 4; and FIG. 7 is a front plan view of the housing of FIG. 6 with parts broken away to show the internal components of the furnace in the housing.

DESCRIPTION OF THE PREFERRED EMBODIMENT

Figure 1:
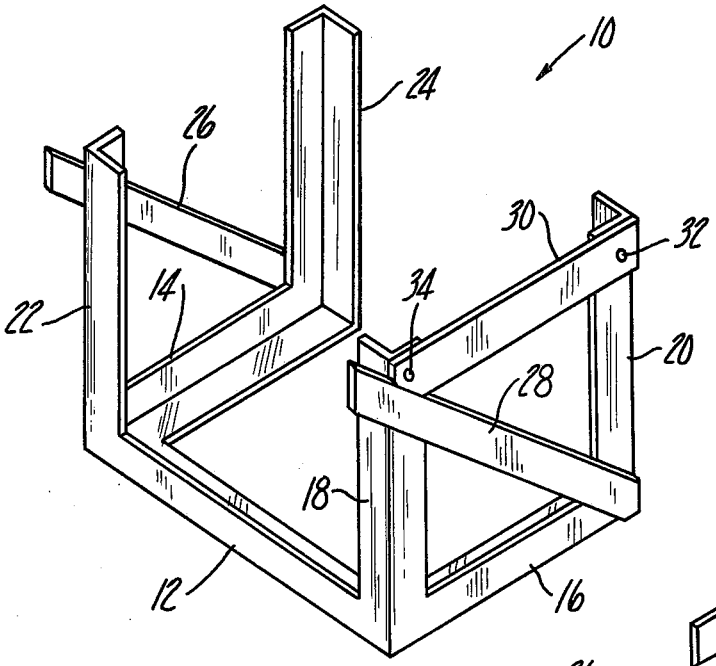
Fig-1 PRIOR ART
FIG. 1 is a perspective view of a framework for an induction furnace that is known in the prior art.
Figure 2:
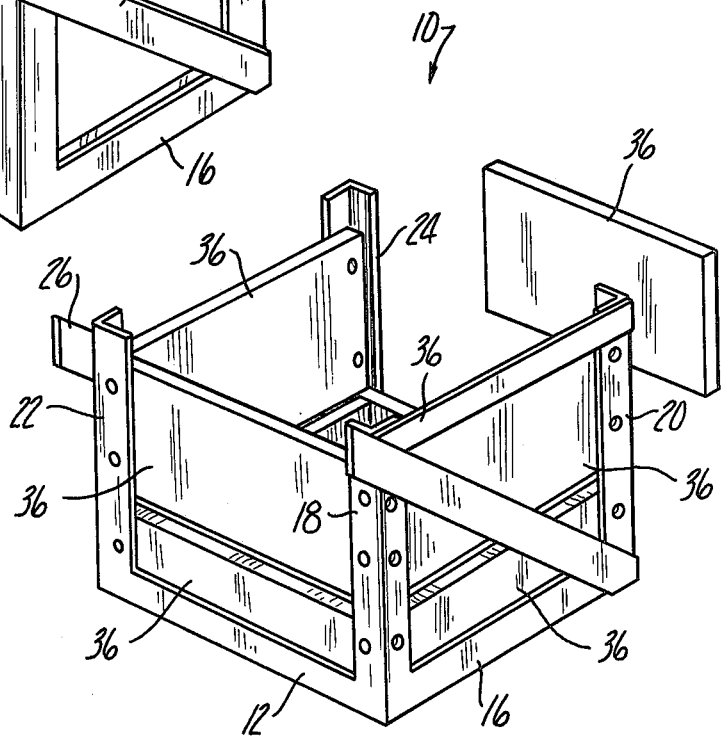
Fig-2 PRIOR ART
FIG. 2 is a perspective view showing a prior art housing utilizing the framework of FIG. 1.

Turning now to FIG. 1, there is shown an example of the heretofore known framework for a coreless induction furnace. The prior art furnace assembly, generally designated by numeral 10, consists of three joined U-shaped members, two in the vertical plane and one in the horizontal plane. Angle beams 12, 14, and 16 comprise the horizontally disposed U-shaped member. Vertically oriented angle beams 18 and 20, along with beam 16, form one of the vertically disposed U-shaped members. Similarly, angle beams 22 and 24, along with beam 14, form the other vertically disposed U-shape member. Two diagonal side struts 26 and 28 provide additional support for the frame 10. In some cases, it has been known to further include an upper support beam 30 to provide further rigidity for the vertically disposed U-shaped members. The beams are either welded or bolted directly together to form the structure. In this example, all of the members are welded directly together except for the beam 30 which is bolted directly to beams 18 and 20 as designated by numerals 32 and 34. Beam 30 is insulated from beams 18 and 20 to prevent the formation of a continuous current path or loop. Referring to FIG. 2, the prior art frame 10 is utilized in a housing assembly with transite (asbestos-cement) panels 36 bolted to the beams to form the completed housing for the internal furnace components.

Figure 3:
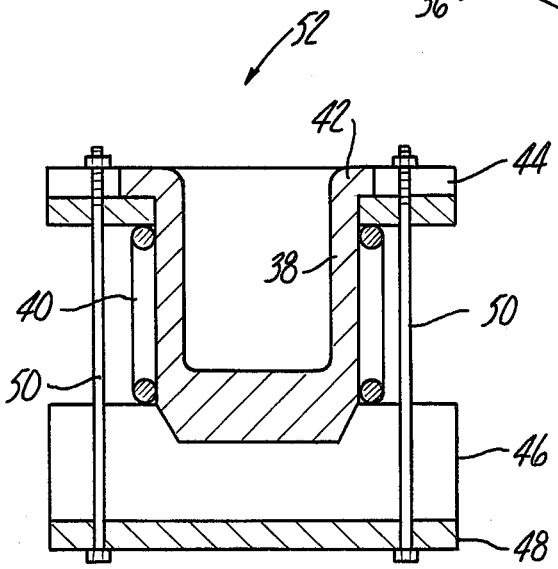
FIG. 3 is a cross sectional view of the internal components for a coreless induction furnace.

An example of internal furnace components for a high frequency coreless induction furnace are shown in FIG. 3. A container 38 made of refractory material is surrounded by an induction coil 40. The upper lip portion 42 of the container 38 is supported by an upper transite panel 44. The lower portion of the container rests in a supporting refractory fixture 46, which in turn is supported by a lower transite panel 48. The components are held together by tie rods 50 to form an assembly 52 which can be inserted in the protective housing. For example, the assembly 52 has heretofore been placed in the prior art housing shown in FIG. 2. Metal is then placed into the container 38 and the coil 40 is activated to heat and melt the metal. The U-shape configuration of the prior art frame 10 prohibits the formation of a continuous current path or loop perpendicular to the axis of coil 40. Consequently, the frame is not heated when the coil 40 is activated. Unfortunately, the frame 10 of the prior art has been found to flex during operation since it lacks the sufficient mechanical rigidity to support the internal furnace assembly 52 and the surrounding panels 36. Such flexure causes, among other things, the transite panels 36 to crack rendering them unfit for further use. Furthermore, while the panels 36 provided temporary protection from the metal splashing onto the coil 40, one of the panels must be physically removed in order to observe the coil 40. This, of course, is a time-consuming requirement.

Turning now to FIG. 4, there is shown the framework 54 of this invention which obviates the disadvantages of the prior art induction furnace housing. The frame 54 of this invention includes upper and lower horizontally disposed rings, 56 and 58, respectively. Each ring 56 and 58 is formed of a rigid, non-magnetic metal, such as aluminum. The exact shape of the rings 56 and 58 may be varied as long as they provide sufficient mechanical rigidity. In this embodiment, rings 56 and 58 are semi-eliptical and are comprised of two arcuate portions which are bridged at one end by a straight beam. Arcuate portions 60 and 62, along with straight beam 64, form upper ring 56. Similarly, arcuate portions 66 and 68, along with straight beam 70, form ring 58. Lower ring 58 includes an inwardly projecting lip portion 71 for supporting a bottom panel in the housing as will be described later in this description. It is an important feature of this invention that although rings 56 and 58 are disposed in a plane perpendicular to the axis of the coil 40, which was thought by those skilled in the art to be undesirable, the rings 56 and 58 do not and cannot provide a continuous current path or loop. This is because the rings are each closed and secured together by an insulated fastener which prevents a continuous current path or loop from being formed in the rings. Insulated fastener 72 joins the arcuate members 60 and 62 of ring 56. Similarly, insulated fastener 74 joins arcurate portions 66 and 68 of ring 58. The exact placement of the insulated fasteners is not critical as long as they break the continuity of the metallic portions of the rings. In fact, more than one insulated fastener per ring can be utilized if desired.

A plurality of vertical columns 76 join upper ring 56 and lower ring 58 together in a spaced relationship to form an open-cage type framework. The beams or columns 76 are similarly constructed of a rigid, non-magnetic metal, such as aluminum. It is another feature of this invention that at least one end of the columns 76 are electrically insulated from the rings 56 or 58. In this embodiment, the lower portions of columns 76 are insulated from lower ring 58 by insulated fasteners 78. This again prevents any undesirable continuous current path or loop from being formed within the framework through portions of the upper and lower rings 56, 58 and the columns 76.

FIG. 5 shows one embodiment of insulated fasteners 72, 74, and 78. Plates 80 and 82 represent two of the mating metallic members of the framework, for example, arcuate portions 60 and 62 of upper ring 56. An insulating partition 84 is sandwiched between members 80 and 82. Bolts 86 are insulatingly mounted to secure the members 80 and 82 together, with the partition 84 insulating the two members. Bolts 86 fit through a flat washer 88, an insulating washer 90, and an insulating sleeve 92, with a lock washer 94 and nut 96 being utilized at the opposite end to complete the connection. Preferably, the metallic parts of the fastener are made of non-magnetic materials. The insulating washer 90 and sleeve 92 are employed to insure that members 80 and 82 remain electrically insulated from each other. It should be noted that other insulating fasteners can be utilized as long as the two mating metallic members are electrically insulated from one another.

The frame of this invention is incorporated into a housing for the internal furnace components as shown in FIGS. 6 and 7. A front transite panel 98 is bolted to the forward columns 76 via bolts 100. Panel 98 along with straight beam 64 and 70 of the upper and lower rings 56 and 58, respectively, provide a continuous protective frontal enclosure for protecting the coil 40 from metal splashing during pouring. As can be seen in FIG. 7, the internal furnace assembly 52 is supported on the lip portion 71 on the lower ring 58 and is surrounded by the housing of this invention. As a further feature of this invention, an expanded aluminum screen 104 is located between upper ring 56 and lower ring 58. Screen 104 is attached to columns 76 by insulating stand offs and completes the enclosure for the internal component assembly 52. The screen 104 not only provides personnel protection by keeping the furnace operator from touching the coil 40, but also permits an operator to observe coil 40 during the melting operation.

It can now be realized that the induction furnace housing of this invention provides a mechanically rigid structure which overcomes the disadvantages of the prior art housings, while at the same time incorporating a unique design which prevents deleterious current paths or loops in the framework which can impede the proper operation of the induction furnace. Therefore, while this invention has been described in connection with a preferred embodiment thereof, it should be understood that various modifications to the invention can be made without departing from the true scope and spirit of the invention as defined by the appended claims.

The embodiments of the invention in which an exclusive property or privilege is claimed are defined as follows:

1. A housing for an induction furnace comprising:
upper and lower horizontally disposed metal rings, each ring having end portions being closed by at least one electrically insulating fastener to prevent a continuous current path through the ring;
a plurality of vertically extending columns; and
means joining the ends of said vertically extending columns to said upper and lower rings, respectively, to form a unitary framework for housing internal furnace components, with at least one end of each column being electrically insulated from one of said rings.

2. The housing of claim 1 which further comprises a protective panel between said upper and lower ring, at least partially enclosing said framework.

3. The housing of claim 2 which further comprises a screen between said upper and lower rings enclosing the remainder of said framework thereby permitting observation of the operation of the furnace within the housing.

4. The housing of claim 3 which further comprises an inwardly projecting lip portion on the lower ring, with a non-conductive bottom enclosure panel being supported on the lip portion.

5. The housing of claim 4 wherein the insulating fastener comprises a non-conductive block between the parts of the framework to be connected and a bolt insulatingly mounted through the framework parts and block to thereby securely fasten the parts together without providing electrical connection therebetween.

6. A housing for a high frequency coreless induction furnace comprising:

upper and lower semi-eliptical ring members, each ring including two arcuate members bridged at one end by a straight beam, said arcuate members being joined at their opposite ends by an insulating fastener which closes the ring but prevents a continuous current loop from being created therein;

a plurality of columns joining said upper and lower rings together to form a framework, said columns being directly secured to the upper ring while being secured by an insulating fastener to the lower ring;

a protective, non-conductive panel between the straight beam portions of the upper and lower rings thereby providing protection to the coil from metal splashing during pouring; and a metallic screen suspended between the arcuate portions of the upper and lower rings thereby permitting observation of the furnace within the framework during operation.

7. The housing of claim 6 which further comprises an inwardly projecting lip portion on the lower ring, with a bottom enclosure panel being supported by the lip portion.

8. The housing of claim 6 wherein the insulating fasteners each comprise a non-conductive block between the parts of the framework to be connected, and a bolt insulatingly mounted through the framework parts and block to securely fasten the parts together without providing electrical connection therebetween.

9. The housing of claim 8 wherein the framework is constructed of non-magnetic metal.

10. The housing of claim 9 wherein the framework is constructed of aluminum.

* * * * *